US007120950B2

(12) United States Patent
Garrigues

(10) Patent No.: US 7,120,950 B2
(45) Date of Patent: Oct. 17, 2006

(54) HYBRID MATTRESS

(75) Inventor: Greg Garrigues, Bozeman, MT (US)

(73) Assignee: Goodway Industrial (H.K.) Ltd., Shantin (HK)

( * ) Notice: Subject to any disclaimer, the term of this patent is extended or adjusted under 35 U.S.C. 154(b) by 0 days.

(21) Appl. No.: 10/894,911

(22) Filed: Jul. 20, 2004

(65) Prior Publication Data

US 2006/0016003 A1 Jan. 26, 2006

(51) Int. Cl.
*A47G 9/06* (2006.01)
*A47C 17/66* (2006.01)

(52) U.S. Cl. ..... 5/420; 5/655.3; 5/656; 5/727

(58) Field of Classification Search ..... 5/417, 5/420, 655.3, 655.9, 656, 502, 740, 727, 5/706, 709, 932, 625–629; 267/142, 143; 128/118.1, 870–873
See application file for complete search history.

(56) References Cited

U.S. PATENT DOCUMENTS 3,047,888 A * 8/1962 Shecter et al. ..... 428/218
3,247,529 A * 4/1966 Benton ..... 5/627
3,414,914 A * 12/1968 Gramins ..... 5/627
3,609,778 A * 10/1971 Zeiner ..... 5/628
3,611,454 A * 10/1971 Klippel ..... 5/625
4,137,584 A * 2/1979 Sharber ..... 5/417
4,186,734 A * 2/1980 Stratton ..... 601/148
4,261,776 A * 4/1981 Lea et al. ..... 156/213
4,534,075 A * 8/1985 Schnitzler ..... 5/628
4,878,258 A * 11/1989 Casey ..... 5/420
5,303,435 A * 4/1994 Haar et al. ..... 5/709
5,392,477 A * 2/1995 Wolter et al. ..... 5/413 AM
5,560,059 A * 10/1996 McQueen ..... 5/625
5,568,662 A * 10/1996 Gougelet ..... 5/625
5,785,669 A * 7/1998 Proctor et al. ..... 601/148
5,855,415 A * 1/1999 Lilley, Jr. ..... 297/452.27
5,902,011 A * 5/1999 Hand et al. ..... 297/284.6
5,974,608 A * 11/1999 Haller et al. ..... 5/709
6,108,835 A * 8/2000 Hwang ..... 5/420
6,138,306 A * 10/2000 Muhanna ..... 5/706
6,393,639 B1 * 5/2002 Ohsner ..... 5/425
6,425,399 B1 * 7/2002 Hoster, Jr. ..... 128/869
6,446,289 B1 * 9/2002 Su et al. ..... 5/709
6,523,202 B1 * 2/2003 Loomos ..... 5/653
2002/0166168 A1 * 11/2002 Weedling et al. ..... 5/81.1 R
2003/0084511 A1 * 5/2003 Salvatini et al. ..... 5/423

(Continued)

OTHER PUBLICATIONS

Jul. 24, 2003 Item #1 "Technically Speaking" Pacific Outdorr Catalog Web Page.

(Continued)

*Primary Examiner*—Meredith C. Petravick
*Assistant Examiner*—Gay Ann Spahn
(74) *Attorney, Agent, or Firm*—Jordan and Hamburg LLP

(57) ABSTRACT

A mattress device has an foam body formed of a closed cell foam material which has a torso support area defining a recess having a recess bottom. An inflatable mat is disposed in the recess and insulated from a ground surface by the recess bottom. The inflatable mat is inflatable to rise above the top surface of the foam body. The foam body is preferably formed of a top foam layer having an aperture defining the recess and a bottom foam layer which provides the recess bottom. The bottom foam layer is formed from material having a higher insulation to weight ratio than material of the top foam layer, and the material of the top foam layer has a higher volume to weight ratio than the material of the bottom foam layer. The inflatable mat is optionally self-inflatable.

18 Claims, 5 Drawing Sheets

U.S. PATENT DOCUMENTS

| | | | | |
|---|---|---|---|---|
| 2003/0097768 | A1* | 5/2003 | Baek | 36/55 |
| 2003/0200972 | A1* | 10/2003 | Crutchfield | 128/845 |
| 2003/0217414 | A1* | 11/2003 | Marson | 5/709 |
| 2004/0187214 | A1* | 9/2004 | Holland | 5/626 |
| 2004/0194344 | A1* | 10/2004 | Tadin | 36/44 |

OTHER PUBLICATIONS

Dec. 1, 2003 Item #2 "Insul Mat products" Pacific Outdoor Equipment, 2004 catalog.
Jul. 1, 2003 Item #3 "Airmat description" Pacific Outdoor Catalog.
Aug. 1, 2002 Item #4 "New Performance Series Mattresses for 2003" Pacific Outdoor Catalog.
Dec. 1, 2003 Item #5 "Picking a Mat" Pacific Outdoor Catalog 2004.
Dec. 1, 2003 Item #6 "x-lite series specifications" Pacific Outdoor Catalog 2004.
Dec. 1, 2003 Item #7 "Insul Mat specifications" Pacific Outdoor Catalog 2004.
Dec. 1, 2003 Item # 8 "Insul Mat specifications" Pacific Outdoor Catalog 2004.
Dec. 1, 2003 Item #9 "max-lite specifications" Pacific Outdoor Catalog 2004.
Dec. 1, 2003 Item #10 "Insul Mat description" Pacific Outdoor Catalog 2004.
Dec. 1, 2003 Item #11 "about p.o.e." Pacific Outdoor Catalog 2004.
Dec. 1, 2003 Item #12 "p.o.e. product specifications" Pacific Outdoor Catalog 2004.
Jul. 24, 2003 Goodway Catalog 2004 Goodway Industrial (H.K.) Ltd., 2 On Yiu St., Shantin, N.T. Hong Kong.

* cited by examiner

HYBRID MATTRESS

BACKGROUND OF THE INVENTION

The present invention relates to a mattress and, more particularly, to a mattress for outdoor use having a foam body and an inflatable mat strategically positioned in the mattress. The foam body may have a multilayer construction including first and second foam layers.

Camping, hiking, climbing and other outdoor enthusiasts often rely on sleeping bags which are placed upon the ground. Because of varying ground conditions, including surface roughness and temperature, various mattress devices for sleeping bags are used. One type employs closed cell foam mats which are placed under the sleeping bag. Depending on the closed cell foam density, significant insulating performance can be achieved with reduced weight. However, such mats sacrifice comfort for the r-value of the denser foam. Another type of mattress device is an inflatable mat which can provide comfort in the form of cushioning and insulation at the expense of weight, i.e., insulating capability, and also bulk. Some inflatable mats include a filling which allows the mat to self-inflate but also results in added bulk and weight.

SUMMARY OF THE INVENTION

Accordingly, it is an object of the invention to provide a mattress for outdoor use which overcomes the drawbacks of the prior art.

It is a further object of the invention to provide a mattress which provides comfortable cushioning while also providing adequate insulation.

It is a still further object of the invention to provide a mattress which provides comfortable cushioning while also providing adequate insulation and reduced weight and bulk.

It is yet another object of the invention to provide a mattress which selectively provides areas of greater insulation while providing other areas of greater cushioning.

It is still another object of the invention to provide a mattress which provides areas of greater insulation at areas corresponding to body regions particularly subject to heat loss while providing other areas of greater cushioning at body areas where greater contact pressure exists between the body and the mattress.

Briefly stated, the present invention provides a mattress device having a foam body formed of a closed cell foam material which has a torso support area defining a recess having a recess bottom. An inflatable mat is disposed in the recess and insulated from a ground surface by the recess bottom. The inflatable mat is inflatable to rise above the top surface of the foam body. The foam body is preferably formed of a top foam layer having an aperture defining the recess and a bottom foam layer which provides the recess bottom. The bottom foam layer is formed from material having a higher insulation to weight ratio than material of the top foam layer, and the material of the top foam layer has a higher volume to weight ratio than the material of the bottom foam layer. The inflatable mat is optionally self-inflatable.

In accordance with these and other objects of the invention, there is provided a mattress device having a foam body formed of a closed cell foam material, the foam body having a bottom surface, a top surface, a head end, a foot end, and a torso support area defining a recess which is recessed relative to the top surface and has a recess bottom. An inflatable mat is disposed in the recess and insulated from a ground surface by the recess bottom and the inflatable mat is inflatable to rise above the top surface of the foam body.

According to a feature of the invention, there is further provided in an embodiment the foam body being formed of a bottom foam layer and a top foam layer. The bottom foam layer has a top surface including the recess bottom and the top foam layer has an aperture defining the recess in conjunction with the recess bottom of the bottom foam layer.

The present invention further includes an embodiment in which the inflatable mat has a flange extending from at least a portion of a perimeter of the inflatable mat and the flange is fixed between the top foam layer and the bottom foam layer.

According to a still further feature of the invention, there is further provided an embodiment wherein the inflatable mat has a shoulder area portion at an end proximate to the head end, a hip area portion at an end nearest the foot end, and a middle mat portion interconnecting the shoulder area portion and the hip area portion, and the middle mat portion has a width less than widths of the shoulder area portion and the hip area portion.

The present invention also includes the above embodiments wherein, in the alternative, various implementations of features of the above embodiments are incorporated. Optionally included are other features. For example, the width of the shoulder area portion is greater than the width of the hip area portion. Another example is the bottom foam layer being formed from material having a higher insulation to weight ratio than material of the top foam layer, and the material of the top foam layer having a higher volume to weight ratio than the material of the bottom foam layer. Such materials may include the bottom foam layer being EVA foam while the top foam layer is PE foam.

The present invention is understood to encompass embodiments which address all or only a portion of the above objects, and include all or any combination of the above features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

DETAILED DESCRIPTION OF THE INVENTION

Figure 1:
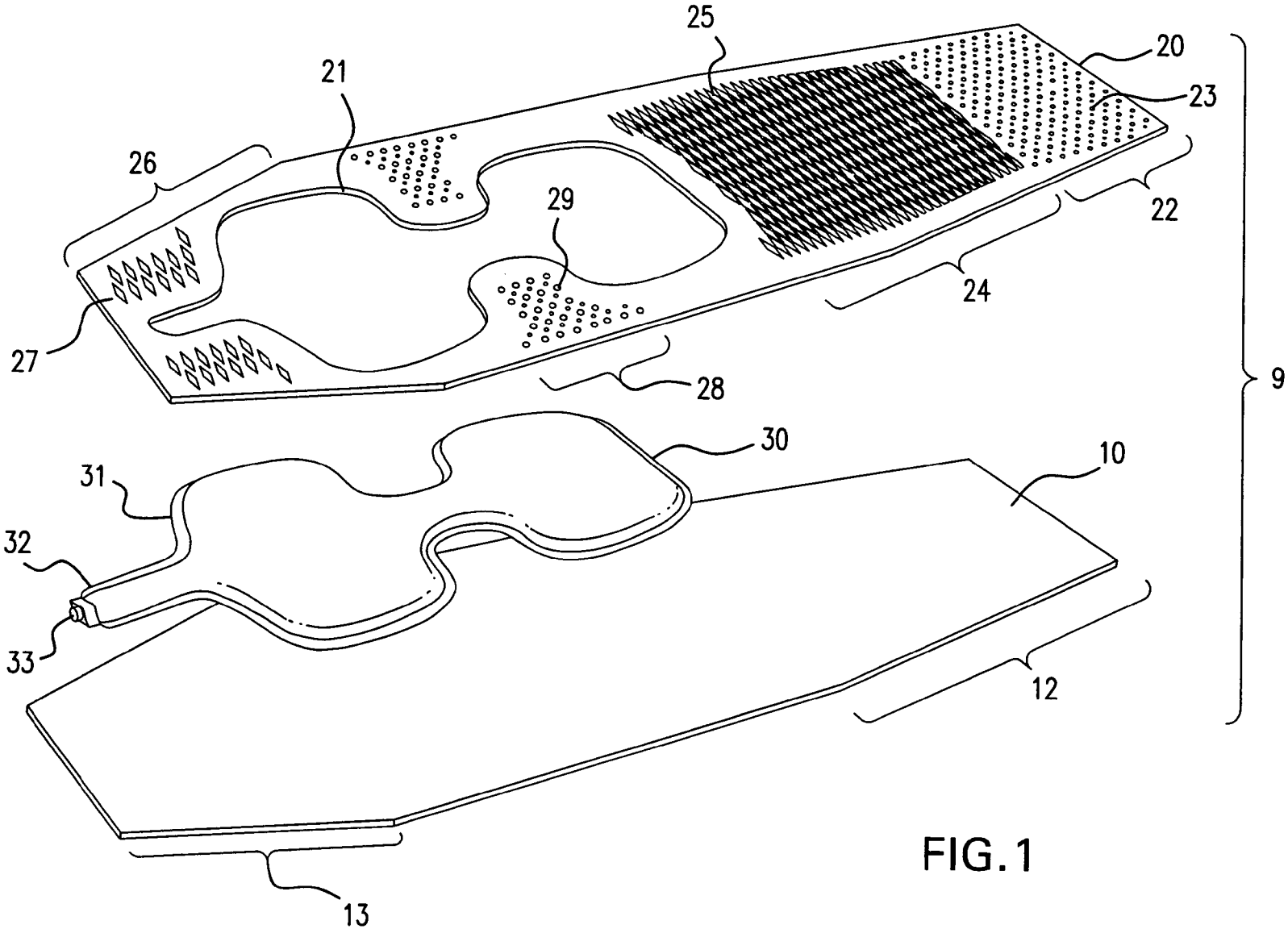
FIG. 1 is an exploded perspective view of components of a mattress of the present invention.
Figure 2:
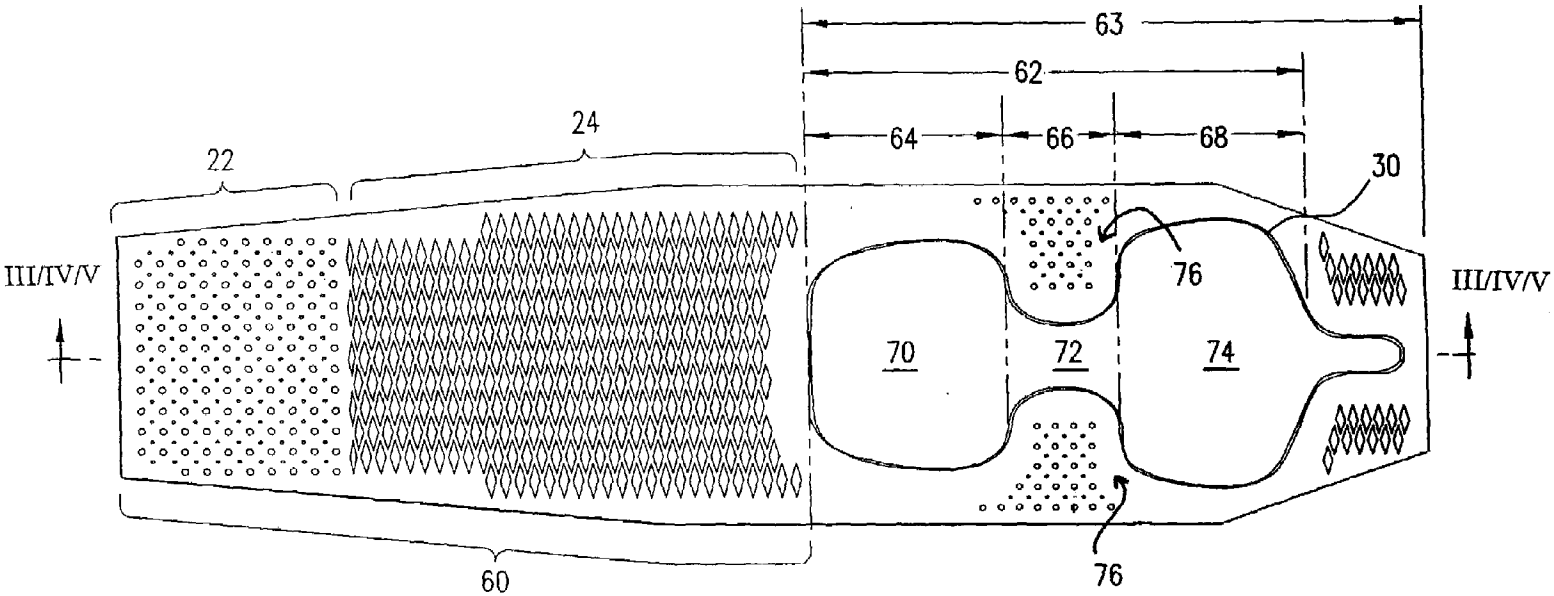
FIG. 2 is a plan view of the mattress of the present invention.
Figure 3:
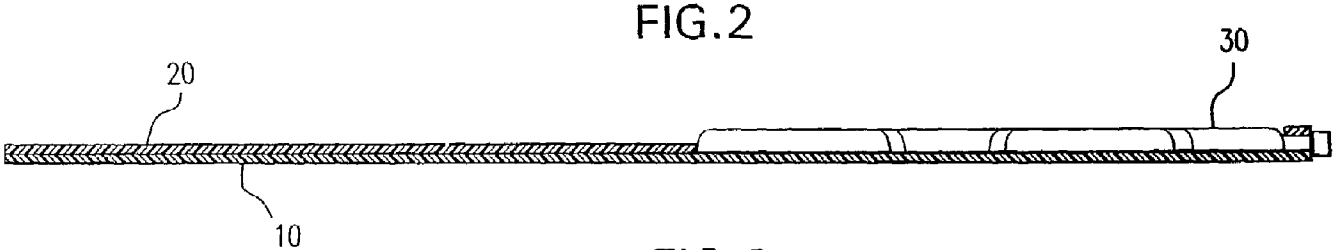
FIG. 3 is a partial cross section of the mattress of the present invention taken along line III/IV/V—III/IV/V of FIG. 2 showing top and bottom foam layers in cross section and a side elevation view of an inflatable mat.
Figure 4:
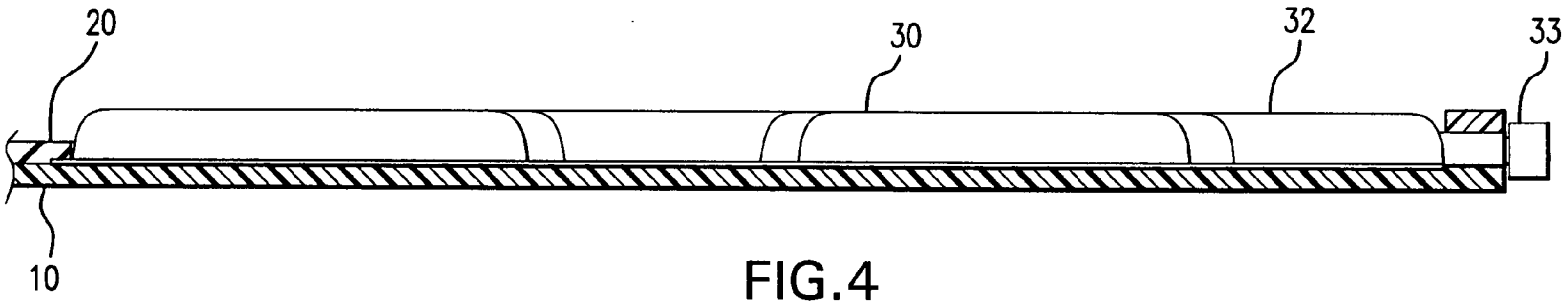
FIG. 4 is an enlarged partial cross section of the mattress of the present invention taken along line III/IV/V—III/IV/V of FIG. 2 showing top and bottom foam layers in cross section and a side elevation view of the inflatable mat.
Figure 6:
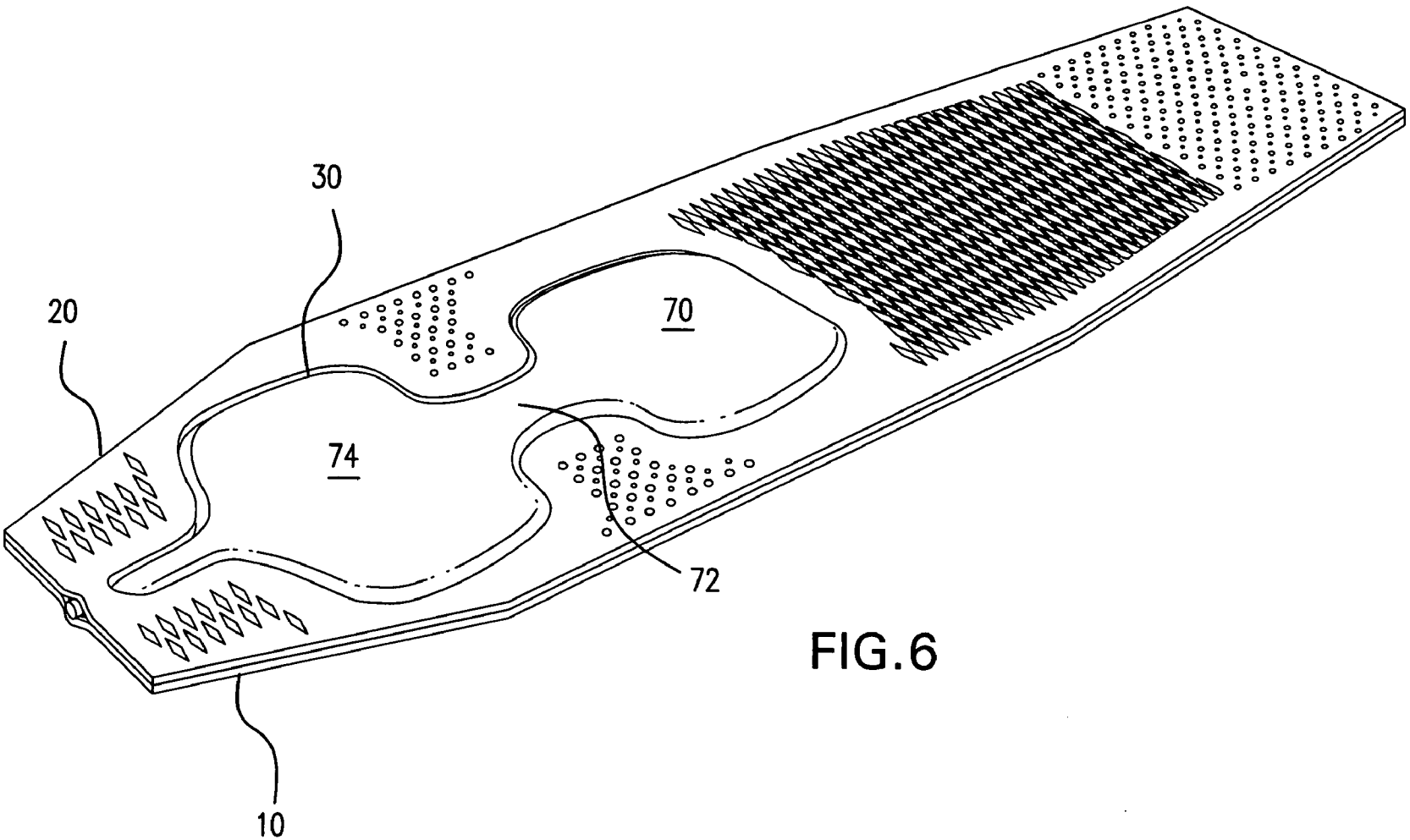
FIG. 6 is a perspective view of the mattress of the present invention.

Referring to FIG. 1, there is shown components of a mattress 9 of the present invention in a exploded format illustrating assemblage of the mattress 9. A bottom foam layer 10, a top foam layer 20, and an inflatable mat 30 are integrated together to provide the completed mattress 9 as shown in FIGS. 2, 3 and 6.

The bottom foam layer 10 is formed of elastic foam material which is preferably EVA (ethylene-vinyl acetate copolymer) and is die cut. The foam material is a closed cell material which provides cushioning, insulation, and a slip resistant bottom surface. The permits the mattress to be used on a variety of surfaces including inclined surfaces such as encountered in mountain climbing. The closed cell structure makes the bottom foam layer 10 resistant to absorbing moisture and provides for excellent insulating action.

The top foam layer 20 is composed of an elastic foam material which is preferably PE (polyethylene), a closed cell foam, and which is die cut. Preferably, either cross-linked expanded polyethylene or surlyn expanded polyethylene foam is used having a density in the range between about 8 $Kg/m^3$ to about 16 $Kg/m^3$. The material for top foam layer 20 is chosen to be softer than the material of the bottom foam layer 10 to provide for greater comfort while the material of the bottom foam layer 10 is chosen for resistance to wear and greater insulating effect.

The provision of a combination of the top foam layer 20 and the bottom foam layer 10 allows an undulating surface to be achieved while providing effective insulation and cushioning. It is an objective of the present invention to do this while maintaining a constant density across the vertical cross section of the closed cell foam. Accordingly, a die-cut and laminate process using the top and bottom foam layers, 20 and 10, is chosen as a preferred construction. Since an objective of the present invention is to provide height (cushion) and r-value from the mattress 9, the bottom foam layer 10 is formed from material having a higher warmth (r-value) to weight ratio than the material for the top foam layer 20. On the other hand, the material for the top foam layer 20 is selected to have a good loft to weight ratio, that is, a higher loft, or thickness, to weight ratio than the material of the bottom foam layer 10 and accordingly, a greater cushioning effect. Accordingly, the bottom foam layer 10 provides for insulation and durability while the top foam layer 10 provides for cushioning and light weight.

Alternatively, molding mirrored surfaces on both sides of a foam layer, which is highly effective in creating cushion and enhancing r-value (using ASTM standard R-value test), may also be used. However, when the ground medium is loose or plastic, soil or snow fills the bottom voids, and reduces a length of a conductive heat path to the sleeper. Molding just a top side is also possible but would increase density into the low areas and reduce the insulation to thickness ratio. While such techniques are not the preferred technique, they may nevertheless be employed in practicing the invention.

A balance of thicknesses of the two closed cell foam layers is desirable. It is preferable that the PE material of the top foam layer 20 is slighter thicker than the EVA material of the bottom foam layer 10 because the top foam layer 20 will be subject to greater compression, and will also provide a smooth transition at the junction between the top foam layer and the inflatable mat 30. Minimum preferred thickness for the closed cell combination of the top and bottom foam layers, 20 and 10, is about 10 mm. However, this thickness is adjusted based on the intended use of the mattress 9. For example, a three season mattress has about a 6_mm PE top foam layer 20 and about a 5 mm EVA bottom foam layer 10, while a four season mattress has about a 6_mm PE top foam layer 20 and about a 7 mm EVA bottom foam layer 10. It has been found preferable to use about a 6_mm thickness for the top foam layer 20 of each of the different models in order to enhance manufacturability, eliminating the requirement for stocking various thicknesses. While the above thicknesses are preferred thicknesses, it is realized that other thicknesses may be employed and the invention is not limited to the preferred thicknesses.

Both the top foam layer 20 and the bottom foam layer 10 have corresponding eight sided shapes. This shaping narrows in a lower portion 12 for accommodating a user's legs and an upper portion 13 for accommodating the user's head area. The narrowing permits the amount of material used to be reduced and thus decreases the weight and bulk of the mattress. Alternatively, other outline shapes may be used such as a simple rectangular shape.

Further weight savings are achieved by die cutting providing a foot area 22 having circular perforations 23, a leg area 24 having diamond shaped perforations 25, a head area 26 having diamond shaped perforations 27, and middle areas 28 having perforations 29. The provision of the laminated top and bottom foam layers, 20 and 10, facilitates applying die-cut patterns and styles in a strategic manner to the top foam layer 20 while allowing the bottom foam layer 10 to be continuous thus providing insulation. Where greater insulation effect of the top foam layer 10 is desired a die cut pattern providing greater density of foam is used, for instance, the foot area 22 has the circular perforations 23 which is a high density pattern. In contrast, in areas requiring less insulation because the body exchanges less heat in those areas, reducing weight and bulk is a major object, while still maintaining heat retaining air pockets, a matrix die-cut pattern is used, for instance, a pattern producing the diamond shaped perforations 25 of the leg area. Furthermore, die-cutting provides for low slip, as a result of a mechanical interaction between the user and ridges that created by the die-cutting. Other patterns of perforations may also be used. Optionally, the perforations may be omitted entirely or only used in limited areas depending on weight savings to be achieved.

Referring to FIGS. 3–6, the inflatable mat 30 is provided on the bottom foam layer 10 and protrudes through the top foam layer 30. In the preferred embodiment the inflatable mat 30 is a self-inflating type as discussed below; however, this feature is optional in practicing the invention. Since the inflatable mat 30 provides cushioning at the expense of insulation effect, the provision of the bottom foam layer 10, with its high r-value, provides good insulation in the area of the inflatable mat 30 and also protects a lower surface of the inflatable mat 30 from damage due to ground contact. The inflatable mat 30 has a flange portion 31 around a perimeter of the inflatable mat 30. The flange portion 31 is a flattened area of the inflatable mat 30 which is sandwiched between the top foam layer 20 and the bottom foam layer 10 when the top foam layer 20 and the bottom foam layer 10 are bonded. The top foam layer 20 has an opening 21 corresponding to a shape of the inflatable mat 30 with the exception of a portion of a neck portion 32 which accommodates a valve 33. The valve 33 is preferably made of brass or anodized aluminum to resist corrosion.

Referring now to FIGS. 2–5, a plan view and cross sections of the mattress are shown. The inflatable mat 30 is composed of a top layer 40, a bottom layer 42 and, in the preferred embodiment, a filling 44 for effecting self-inflation. Preferably the top and bottom layers, 40 and 42, are formed of material selected from nylon fabric, polyester fabric, PU (polyurethane) film, or TPU (thermoplastic polyurethane) film. The fabrics are preferably coated with polyurethane using dual knife edge coating to render them air impermeable. Other materials may be used provided they are air impermeable. For example, a laminated air tight member may be applied as an alternative to the polyurethane coating. However, such a construction may be prone to de-lamination but is still considered an alternative within the realm of the present invention.

In the preferred embodiment the filling 44 is polyurethane open cell foam, preferably having a density of about 20 $Kg/m^3$, which elastically expands to draw air into the inflatable mat 30 when the valve 33 is opened. Hence, the inflatable mat 30 is self-inflating. The filler 44 is optionally treated with an antifungal agent. Other materials may be used for the filler 44 provided they sufficiently expand to draw air into the inflatable mat 30. Once the air is drawn in, the valve 33 is closed. When the mattress is not in use and is being stored or transported, the valve 33 is opened and the inflatable mat 30 is compressed to expel air out and the valve 33 is then closed so that the inflatable mat 30 remains in a compressed state thus presenting less bulk and facilitating transport and storage.

In a preferred embodiment the valve 33 is a screw type valve which opens and closes when rotated and has a screen to prevent debris from entering the inflatable mat 30. However, it is realized that other types of valves may be used provided they sufficiently seal the inflatable mat 30 so that air is retained therein when body weight is applied to the inflatable mat 30. Alternatively, it is conceivable that the valve 33 may be replaced with a screw cap or a clamp device.

Figure 5:
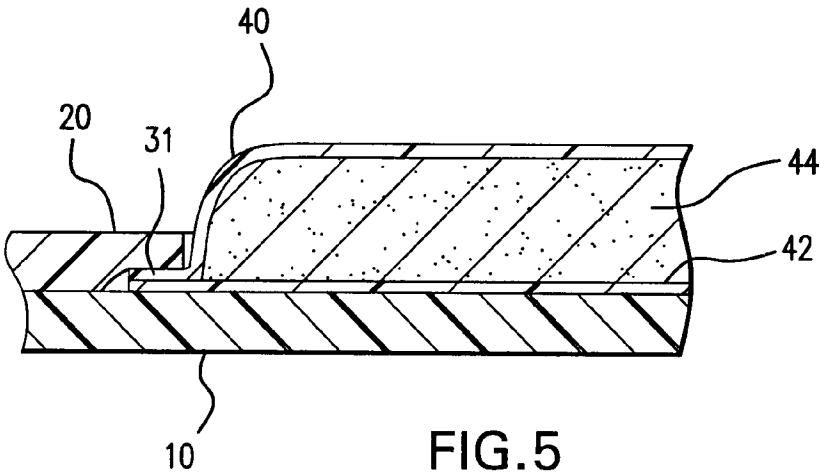
FIG. 5 is an enlarged cross section of the mattress of the present invention taken along line III/IV/V—III/IV/V of FIG. 2 showing top and bottom foam layers and the inflatable mat in cross section.

Referring to FIG. 5, the top layer 40 and the bottom layer 42 are bonded together using a solvent base adhesive and a heat sealing process at the flange portion 31 and with the filling 44 encased therebetween to form the inflatable mat 30. The filling 44 is also bonded to the like material polyurethane coating of the fabrics. The inflatable mat 30 is then positioned aligned with the opening 21 in the top foam layer 20 and the top and bottom foam layers, 20 and 10, are bonded together, using a solvent based adhesive, with the flange portion 31 sandwiched between the top and bottom foam layers, 20 and 10, thus securing the inflatable mat 30 in place. Heat and pressure are optionally use to enhance bonding.

In a preferred assembly method, the inflatable mat 30 is first aligned in the opening 21 of the top foam layer 20 and the flange portion 31 is bonded to the top foam layer 20 using the solvent based adhesive. The top and bottom foam layers, 20 and 10, are then bonded together using solvent based adhesive. It will be realized by those skilled in the art having the benefit of this disclosure that other bonding techniques including heat activated adhesive, flame lamination, or heat sealing may be used. Alternative constructions may also be realized by those skilled in the art having the benefit of the present disclosure which omit the flange portion 31. In such instances the inflatable mat 30 may simply be bonded to the bottom foam layer 10 or be held in place with other fastening devices including detachable ones such as snaps, buttons, zippers or VELCRO (hook and loop) which permit replacement of the inflatable mat 30.

Figure 7:
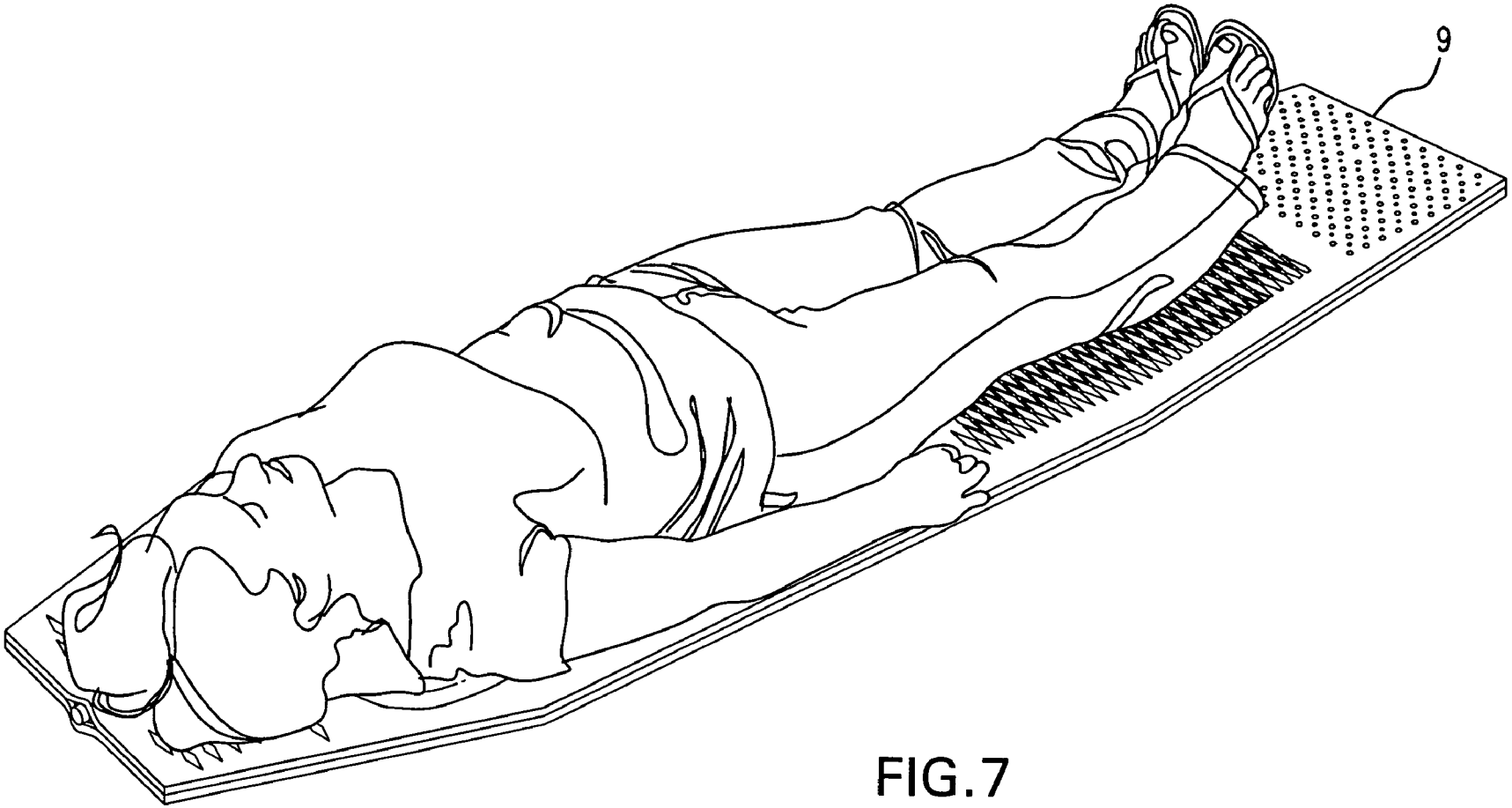
FIG. 7 is a perspective view of the mattress of the present invention in use.

Referring again to FIG. 2 and also to FIGS. 6 and 7, a lower mattress portion 60 of the mattress 9 is a portion for accommodating the legs and feet of the user while the inflatable mat 30 is provided in a mattress torso portion 62 provided for accommodating the torso. The inflatable mat 30 has three regions, a lower mat region 70, a middle mat region 72 and an upper mat region 74. The upper mat region 74 supports the user's shoulders which are one of four points that contact for a back sleeper. The user's head is generally supported by an improvised pillow (not shown). The lower mat region 70 supports the user's buttocks for a back sleeper or hips for a side sleeper. In between, the middle mat region 72 is narrowed to provide support for the spine while allowing greater insulation provided by the combination of the top and bottom foam layers, 20 and 10, in notch areas 76. The upper mat region 74 is optionally slightly larger than the lower mat region 70 to accommodate a wider spread of the shoulders than the hips, i.e., a shoulder to waist taper. Similarly, a bilateral taper is provided in the upper mat region 74. The waist and bilateral tapers, and tapers provided at the notch areas 76 in the middle mat region 72 serve to minimize areas devoted to the inflatable mat 30 and corresponds to an area of back arch where contact minimized. The inflatable mat 30 is heavier than the top and bottom foam layers, 20 and 10, thus weight savings are achieved by minimizing its area to those portions most benefitting from the added cushion of the inflatable mat 30. Concurrently, the area of the top and bottom foam layers, 20 and 10, which provide better insulation are increased. Thus, limiting the inflatable mat 30 to the mattress torso portion 62 produces a lighter mattress than if the inflatable mat 30 extended a greater length of the mattress and results in less bulk. Accordingly, a hybrid of technologies is provided.

While the mattress torso portion 62 is shown shorter than the lower mattress portion 60 this apportionment is not required. The lower mattress portion 60 is may optionally be shorter than the mattress torso portion 62. The spacing of the upper mat region 74 and the lower mat region 70 is to accommodate a range of hip to shoulder spacings (torso lengths) ranging from 38 cm to 56 cm. In a preferred embodiment an upper mat region length 68 of the upper mat region 74, a middle mat region length 66 of the middle mat region 72, and a lower mat region length 64 of the lower mat region are respectively about 12", 6", and 12". The difference in length between the upper mattress portion 63 and the mattress torso portion is about 7".

In a preferred embodiment, the upper mat region 74 has a greatest width of about 41 cm, the lower mat region 70 has a greatest width of about 36 cm, and the middle mat region 72 has a narrowest width of about 10 cm. It is within the realm of the present invention to vary these widths by amounts which maintain the general shape of the inflatable mat 30 yet provide weight savings by only having the inflatable mat 30 in areas where body pressure is greater than average. For example, the widths of the upper and lower mat regions, 74 and 70, may vary 50% while the width of the middle mat region 72 may vary 100%. Alternatively, embodiments of the present invention can optionally have a mat which does not have the narrowed middle region. In a preferred embodiment, ratios of the noted dimensions may vary 25%.

The inflatable mat 30 preferably rises to provide the mattress 9 with a total thickness of 3.5 cm when inflated and compresses to a level flush with the surface of the top foam layer 20. However, the mattress 9 may be constructed to other dimensions and the inflatable mat 30 need not compress to be flush with the top foam layer 20. The feet, with less weight and sensitivity to pressure, but enhanced sensitivity to cold, are supported by the top and bottom foam layers, 20 and 10, at the foot area 22 having a denser die-cut pattern in than the rest of the top foam layer.

While reducing weight and bulk is an advantageous feature, certain applications, such as motor camping, do not place a premium on weight and space such as backpacking or mountaineering would. Therefore, the inflatable mat 30 may optionally extend over a greater length of the mattress, throughout the leg area 24 if desired. Furthermore, the inflatable mat 30 may also be produced without the narrowing in the middle mat region 72 and may even only provide the upper mat region 74.

Alternatively, weight savings may be effected by shortening the lower mattress portion 60 relative to an upper mattress portion 63. Table 1 below presents various combinations of dimensions for alternative embodiments of the present invention.

TABLE 1

| EMBODIMENT | UPPER MATTRESS DIMENSION | LOWER MATTRESS DIMENSION | UPPER TO LOWER RATIO |
|---|---|---|---|
| 1 | 37" | 41" | 0.90 |
| 2 | 37" | 31" | 1.19 |
| 3 | 37" | 11" | 3.36 |
| 4 | 37" | 29" | 1.28 |

Unless otherwise stated, dimensions recited herein reflect preferred embodiments, and deviations from the dimensions may be realized by those skilled in the art without deviating from the metes and bounds of the present invention unless otherwise claimed. Additionally, the dimension for the upper mattress portion may be varied to accommodate users other than adults and hence may vary up to 50% or more with above ratios applied. Furthermore, the dimensions and ratios presented are considered also to define ranges encompassed by the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An outdoor use mattress for supporting a user in a prone position above a ground surface upon which the outdoor use mattress is placed, comprising:

a foam body formed of a foam material, the foam body having a foam body bottom surface, a foam body top surface, a head end, a foot end, and a torso support area defining a recess which is recessed relative to said top surface and has a recess bottom;

an inflatable mat disposed in said recess and insulated from the ground surface by said recess bottom;

said foam body being formed of a bottom foam layer and a top foam layer;

said bottom foam layer having a bottom foam layer top surface extending across an area of said recess bottom to support said inflatable mat;

said top foam layer having an aperture defining said recess in conjunction with said recess bottom of said bottom foam layer, said inflatable mat being disposed in said aperture; and said inflatable mat having a flange extending from at least a portion of a perimeter of the inflatable mat and said flange is fixed between said top foam layer and said bottom foam layer.

2. The outdoor use mattress of claim 1 wherein said inflatable mat has a shoulder area portion at an end proximate to said head end, a hip area portion at an end nearest said foot end, and a middle mat portion interconnecting said shoulder area portion and said hip area portion, and said middle mat portion has a width less than widths of said shoulder area portion and said hip area portion.

3. The outdoor use mattress of claim 2 wherein the width of said shoulder area portion is greater than the width of said hip area portion.

4. The outdoor use mattress of claim 3 wherein said inflatable mat has an expandable elastic filling sufficient to effect self inflation of the inflatable mat.

5. The outdoor use mattress of claim 4 wherein the bottom foam layer is formed from material having a higher warmth to weight ratio than material of the top foam layer, and the material of the top foam layer has a higher volume to weight ratio than the material of the bottom foam layer.

6. The outdoor use mattress of claim 3 wherein the bottom foam layer is formed from material having a higher insulation to weight ratio than material of the top foam layer, and the material of the top foam layer has a higher volume to weight ratio than the material of the bottom foam layer.

7. The outdoor use mattress of claim 2 wherein the bottom foam layer is formed from material having a higher insulation to weight ratio than material of the top foam layer, and the material of the top foam layer has a higher volume to weight ratio than the material of the bottom foam layer.

8. The outdoor use mattress of claim 1 wherein the bottom foam layer is formed from material having a higher insulation to weight ratio than material of the top foam layer, and the material of the top foam layer has a higher volume to weight ratio than the material of the bottom foam layer.

9. The outdoor use mattress of claim 1 wherein said top foam layer is an uppermost foam layer of the outdoor use mattress and has a top foam layer top surface forming said foam body top surface, and said inflatable mat inflates to rise above said foam body top surface.

10. An outdoor use mattress for supporting a user in a prone position above a ground surface upon which the outdoor use mattress is placed, comprising:

a foam body formed of a foam material configured to define a perimeter of said outdoor use mattress, the foam body having a foam body bottom surface, a foam body top surface, a head end, a foot end, an upper body mattress portion extending from said head end and toward said foot end, and a lower body mattress portion extending from said foot end to said upper body mattress portion configured to extend beneath the legs of the user when in the prone position, said lower body mattress portion having a lower body mattress length extending in the head end to the foot end direction;

said upper body mattress portion having an upper body mattress length extending in the head end to the foot end direction and including a torso support area defining a recess which is recessed relative to said foam body top surface and has a recess bottom, said recess extending to a junction of said upper body mattress portion and said lower body mattress portion;

an inflatable mat disposed in said recess and insulated from the ground surface by said recess bottom, said inflatable mat not extending into said lower body mattress portion;

said foam body being formed of a bottom foam layer and a top foam layer, said bottom foam layer being formed of an elastic foam material and said top foam layer being formed of an elastic foam material;

said bottom foam layer having a bottom foam layer top surface extending across an area of said recess bottom to support said inflatable mat; and said top foam layer having an aperture defining said recess in conjunction with said recess bottom of said bottom foam layer, said inflatable mat being disposed in said aperture.

11. The outdoor use mattress of claim 10 wherein said inflatable mat has a shoulder area portion at an end proximate to said head end, a hip area portion at an end nearest said foot end, and a middle mat portion interconnecting said shoulder area portion and said hip area portion, and said middle mat portion has a width less than widths of said shoulder area portion and said hip area portion.

12. The outdoor use mattress of claim 11 wherein the width of said shoulder area portion is greater than the width of said hip area portion.

13. The outdoor use mattress of claim 12 wherein said inflatable mat has an expandable elastic filling sufficient to effect self inflation of the inflatable mat.

14. The outdoor use mattress of claim 11 wherein said inflatable mat has an expandable elastic filling sufficient to effect self inflation of the inflatable mat.

15. The outdoor use mattress of claim 10 wherein the bottom foam layer is formed from material having a higher insulation to weight ratio than material of the top foam layer, and the material of the top foam layer has a higher volume to weight ratio than the material of the bottom foam layer.

16. The outdoor use mattress of claim 15 wherein the bottom foam layer is formed from EVA (ethylene-vinyl acetate copolymer) and the top foam layer is formed from PE (polyethylene).

17. The outdoor use mattress of claim 10 wherein the bottom foam layer is formed from EVA (ethylene-vinyl acetate copolymer) and the top foam layer is formed from PE (polyethylene).

18. The outdoor use mattress of claim 1 wherein said top foam layer is an uppermost foam layer of the outdoor use mattress and has a top foam layer top surface forming said foam body top surface, and said inflatable mat inflates to rise above said foam body top surface.

* * * * *